US006966872B2

(12) United States Patent
Eschenbach

(10) Patent No.: US 6,966,872 B2
(45) Date of Patent: Nov. 22, 2005

(54) ARTICULATING ABDOMINAL EXERCISE BENCH

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 108 days.

(21) Appl. No.: 10/263,879

(22) Filed: Oct. 4, 2002

(65) Prior Publication Data

US 2004/0067829 A1 Apr. 8, 2004

(51) Int. Cl.[7] ..... A63B 26/00

(52) U.S. Cl. ..... 482/142; 482/95; 482/96; 297/85

(58) Field of Search ..... 482/142, 140, 482/907, 91, 121–133, 95, 96; 297/125, 270.1, 297/85, 68; 601/148–149; 600/300

(56) References Cited

U.S. PATENT DOCUMENTS

| | | | | | |
|---|---|---|---|---|---|
| 1,973,945 | A | | 9/1934 | Chavin et al. | |
| 3,880,462 | A | * | 4/1975 | Mednick | 297/84 |
| 4,365,836 | A | * | 12/1982 | Jackson et al. | 297/85 |
| 4,367,895 | A | * | 1/1983 | Pacitti et al. | 297/85 |
| 4,405,128 | A | | 9/1983 | Mclaughlin et al. | 272/117 |
| 4,582,319 | A | | 4/1986 | Luna | 272/136 |
| 4,583,731 | A | | 4/1986 | Crivello et al. | 272/144 |
| 4,902,003 | A | | 2/1990 | Buoni | 272/93 |
| 4,915,444 | A | * | 4/1990 | Rogers, Jr. | 297/68 |
| 5,094,449 | A | | 3/1992 | Stearns | 272/134 |
| 5,110,122 | A | | 5/1992 | Moore et al. | 482/134 |
| 5,125,884 | A | * | 6/1992 | Weber et al. | 482/145 |
| 5,147,259 | A | | 9/1992 | Hutchins | 482/101 |
| 5,215,511 | A | | 6/1993 | Cheng | 482/121 |
| 5,256,126 | A | | 10/1993 | Grotstein | 482/142 |
| 5,300,005 | A | | 4/1994 | Wang | 482/142 |
| 5,346,447 | A | | 9/1994 | Stearns | 482/96 |
| 5,498,222 | A | | 3/1996 | Hur | 482/112 |
| 5,545,114 | A | | 8/1996 | Gvoich | 482/140 |
| 5,547,245 | A | * | 8/1996 | Knouse | 297/85 |
| 5,573,485 | A | | 11/1996 | Geschwender | 482/112 |
| 5,601,301 | A | | 2/1997 | Liu | 280/233 |
| 5,624,361 | A | | 4/1997 | Lai | 482/130 |
| 5,665,041 | A | | 9/1997 | Hsieh | 482/140 |
| 5,702,332 | A | | 12/1997 | Hsieh | 482/130 |
| 5,702,334 | A | | 12/1997 | Lee | 482/140 |
| 5,711,749 | A | | 1/1998 | Miller | 482/135 |
| 5,759,137 | A | | 6/1998 | Huang | 482/72 |
| 5,769,766 | A | | 6/1998 | Huang | 482/140 |
| 5,779,607 | A | | 7/1998 | Harris | 482/140 |
| 5,833,590 | A | | 11/1998 | Chiu et al. | 482/142 |
| 5,868,654 | A | | 2/1999 | Norian | 482/140 |
| 5,931,768 | A | | 8/1999 | Amesquita | 482/140 |
| 6,000,758 | A | * | 12/1999 | Schaffner et al. | 297/344.17 |
| 6,152,866 | A | * | 11/2000 | Kuo | 482/142 |

(Continued)

*Primary Examiner*—Stephen R. Crow
*Assistant Examiner*—L. Amerson

(57) ABSTRACT

The invention relates to the field of abdominal exercise with the operator using the sit-up or crunch movements. More particularly, an exercise apparatus that exercises the abdominal and back muscles with the lower torso of the operator supported by a moving seat while the upper torso of the operator is supported by a moving seatback. Continuous support of the lower back prevents back strain. The articulation of the seatback is coordinated with the movement of the seat. Adjustment is provided to adjust the rate of movement of the seat relative to the seatback. Handles are provided such that the arm muscles can assist the sit-up or crunch movements.

22 Claims, 6 Drawing Sheets

U.S. PATENT DOCUMENTS 6,186,926 B1 2/2001 Ellis ..... 482/97
6,206,809 B1 3/2001 Habing et al. ..... 482/196
6,220,996 B1 4/2001 McAuthur ..... 482/142
6,270,446 B1 8/2001 Abelbeck et al. ..... 482/57
6,544,154 B2 * 4/2003 Forcillo ..... 482/142
6,752,745 B1 * 6/2004 Davis ..... 482/72
2003/0087737 A1 * 5/2003 Studdard
2004/0229738 A1 * 11/2004 Hobson ..... 482/148

* cited by examiner

ARTICULATING ABDOMINAL EXERCISE BENCH

BACKGROUND OF THE INVENTION

1. Field

The present invention relates to the field of abdominal exercise with the operator using the sit-up or crunch movements. More particularly, the present invention relates to an exercise apparatus that exercises the abdominal and back muscles with the lower torso of the operator supported by a moving seat while the upper torso of the operator is supported by a moving seatback. The articulation of the seatback is coordinated with the movement of the seat. Handles are provided such that the arm muscles can assist the sit-up or crunch movements.

2. State of the Art

The benefits of regular exercise to improve overall health, appearance and longevity are well documented in the literature. One of the most difficult muscle groups to exercise is the abdominals. For exercise enthusiasts the search continues for safe apparatus that provides exercise to tone the abdominals without back strain.

Many devices have appeared in the art to aid the user in the performance of sit-ups from a prone face-up position causing either more or less load on the abdominal muscles. The first category shows a stationary seat and seatback with relative operator movement such as Luna in U.S. Pat. No. 4,582,319, Geschwender in U.S. Pat. No. 5,573,485, Mclaughlin et al. in U.S. Pat. No. 4,405,128 and McArthur in U.S. Pat. No. 6,220,996.

A second category has the seat and seatback combined to move with the operator such as Stearns in U.S. Pat. No. 5,346,447, Buoni in U.S. Pat. No. 4,902,003 and Crivello et al. in U.S. Pat. No. 4,583,731. A third category has a stationary seat with moving setback such as Chavin et al. in U.S. Pat. No. 1,973,945, Moore et al. in U.S. Pat. No. 5,110,122, Hutchins in U.S. Pat. No. 5,147,259, Grotstein in U.S. Pat. No. 5,256,126, Wang in U.S. Pat. No. 5,300,005, Hur in U.S. Pat. No. 5,498,222, Lai in U.S. Pat. No. 5,624,361, Hsieh in U.S. Pat. No. 5,702,332, Norian in U.S. Pat. No. 5,868,654 and Amesquita in U.S. Pat. No. 5,931,768.

The fourth category has a stationary seat with a moving seatback coordinated with leg movement such as Cheng in U.S. Pat. No. 5,215,511, Gvoich in U.S. Pat. No. 5,545,114, Hsieh in U.S. Pat. No. 5,665,041, Huang in U.S. Pat. No. 5,769,766, Harris in U.S. Pat. No. 5,779,607, Ellis in U.S. Pat. No. 6,186,926 and Abelbeck et al. in U.S. Pat. No. 6,270,446.

The fifth category has a moving seat with a moving seatback, arm movement or leg movement such as a swivel seat movement with Stearns in U.S. Pat. No. 5,094,449, a back and forth seat movement with Liu in U.S. Pat. No. 5,601,301, a rising seat with rising a seatback in Lee U.S. Pat. No. 5,702,334, a swinging seat tied into leg movement in Miller U.S. Pat. No. 5,711,749, a back and forth seat movement with seatback movement tied into hand movement in Huang U.S. Pat. No. 5,759,137 and a rising seat with lowering seatback in U.S. Pat. No. 5,833,590. Habing et al. U.S. Pat. No. 6,206,809 shows a stationary seatback with rising seat.

None of the prior art reviewed including samples above address a moving seat coordinated with a moving seatback for abdominal muscle exercise. One of the objectives of the present invention is to provide a moving seat to support the lower torso of the operator coordinated with the movement of a seatback that supports the upper torso of the operator during sit-up or crunch exercise.

Another objective of this invention is to provide a means for adjusting the movement of the seat relative to the movement of the seatback. Another objective of this invention is to exercise the abdominal muscles in a novel manner without back strain. Another objective of this invention is to provide sit-up assist using the arm muscles acting upon moving handles. Another objective of the present invention is to provide damping resistance to the seatback to allow abdominal muscle relaxation.

SUMMARY OF THE INVENTION

The present invention provides a seat to support the lower torso of the operator that is pivotally connected to a framework at the portion of the seat nearest the leg of the operator. A seatback to support the upper torso of the operator is pivotally connected to the framework at the portion of the seatback nearest the seat. The headend of the seatback rests on the framework when the operator is not using the seat.

A linkage is pivoted to the framework, the seat and to the seatback to coordinate movement of the seat with the seatback. When the operator sits upon the seat, the rear portion of the seat lowers to cause the headend of the seatback to rise with a rotation about the seatback pivots due to the linkage relationship. Several adjustments are provided to change the movement of the seat relative to the seatback movement. A heavier operator would adjust the seat to lower more than a lighter operator. As the operator strengthens the abdominal muscles over time, the seat movement can be reduced by simple adjustment for more difficult sit-ups or crunches.

Handles are attached to the seat to allow the arm muscles to aid the abdominal muscles during a sit-up or crunch movement. A second set of handles are attached to the headend of the seatback to use the hands during a more difficult sit-up or crunch movement. Damping resistance controls the speed of the seatback.

The operator begins by siting upon the seat which lowers to allow the seatback to make contact with the upper torso of the operator. To begin crunches, the operator would lean back against the resistance of the damping upon the seatback to about 40 degrees elevation, then flexing the abdominal muscles to cause the seatback to elevate to approx. 60 degrees whereupon the abdominal muscles are relaxed allowing the damping to retard the seatback return to 40 degrees. The crunch cycle is repeated as often as desired. The damping is adjustable to vary the speed of the seatback for faster or slower crunches. It is important to recognize that the small of the back is in continuous contact with the seatback during situp or crunch movements allowing the spine to remain straight thus reducing back strain.

More conventional sit-up movement is possible by allowing the seatback to return near horizontal then flexing the abdominal muscles to elevate the seatback nearly vertical. Either set of handles may be used. At the end of the exercise, the operator will rise from the seat to allow the seatback to slowly return to the horizontal position. A retractable shelf is available to position the feet off the ground during certain sit-up or crunch movements.

The embodiment shown contains a minimum number of elements that comprise the seat, seatback and linkage to coordinate the movements of the seatback with the movement of the seat during sit-up or crunch movements. It should be obvious that other means to coordinate the movements of a seat and seatback can also be used during a sit-up or crunch movement of an operator and are considered within the scope of the present invention.

The embodiment disclosed provides assisted sit-up and crunch movements of and operator which exercises the abdominals and back muscles in a novel and improved manner without back strain.

BRIEF DESCRIPTION OF THE DRAWINGS

The foregoing and other objects and features of the present invention will become more fully apparent from the following description and claims, taken in conjunction with the drawings. Understanding that these drawings depict only typical an embodiment of the invention and are, therefore, not to be considered limiting of its scope or combinations, the invention will be described with addition specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiment of the system and method of the present invention, as represented in FIGS. 1 through 6, is not intended to limit the scope of the invention, as claimed, but is merely representative of the presently preferred embodiment of the invention.

Figure 1:
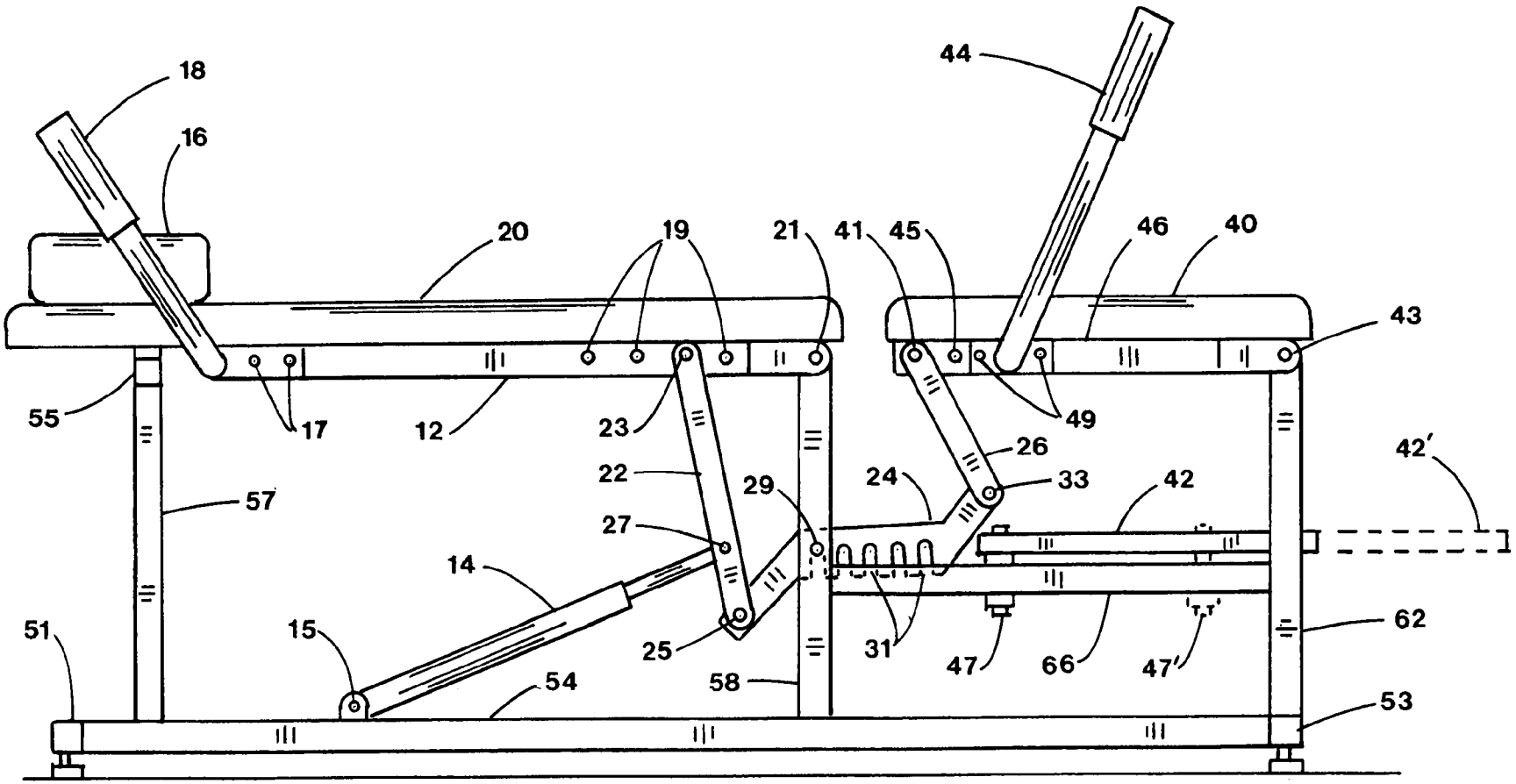
FIG. 1 is a side elevation view of the preferred embodiment of the present invention at rest.
Figure 2:
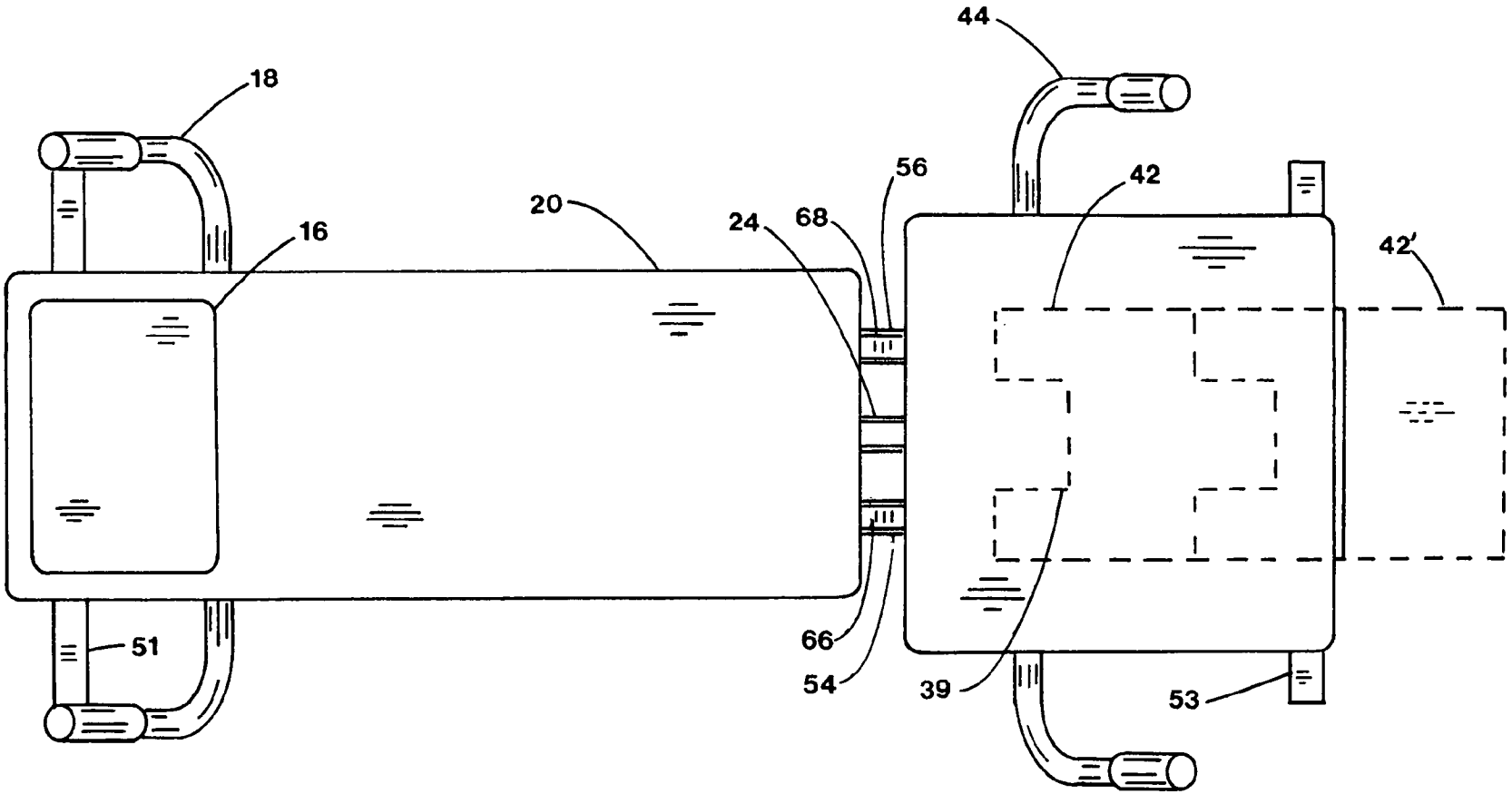
FIG. 2 is a plan view of the preferred embodiment shown in FIG. 1.
Figure 3:
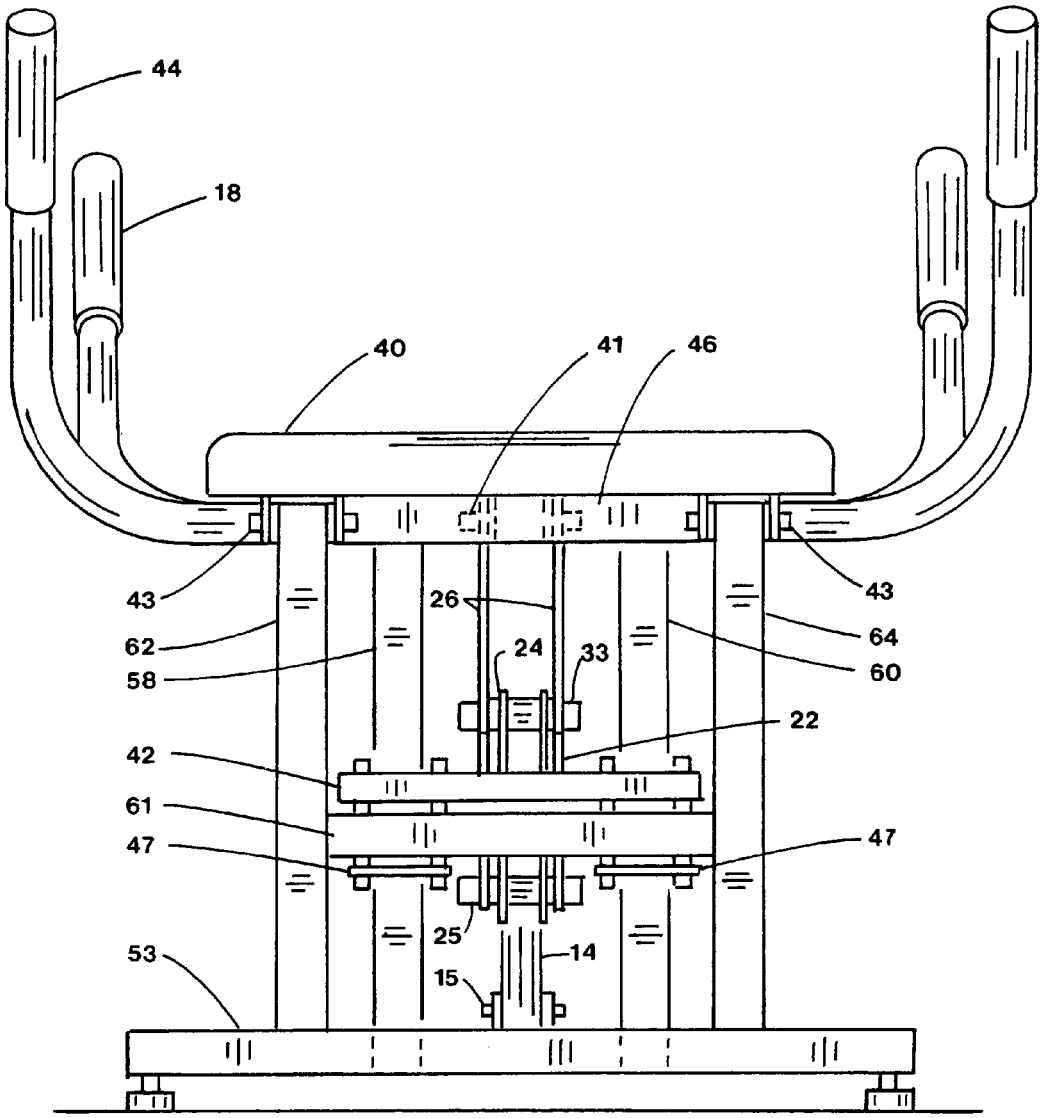
FIG. 3 is a seat end view of the preferred embodiment shown in FIGS. 1 and 2.

In the preferred embodiment shown in FIGS. 1, 2 and 3, seat 40 is attached to seat support 46 which is connected to frame members 62 and 64 by pivots 43. Seatback 20 is attached to seatback support 12 which is connected to frame members 58/60 by pivots 21. Seatback 20 is supported in the rest position by frame member 55.

A linkage composed of members 22, 24 and 26 coordinates the movement of seatback 20 to the movement of seat 40. Link 26 is connected to seat support 46 at pivot 41 and to rack link 24 at pivot 33. Rack link 24 has multiple slots 31, each of which can be used to rotate rack link 24 about pivot 29 positioned on frame members 58/60. Link 22 is connected to the rack link 24 at pivot 25 and to seatback support 12 at pivot 23. Other pivot locations 19 and 45 may be used to connect links 22 and 26 to adjust the relative movement of the seat 40 to the seatback 20.

Damping cylinder 14 is connected to link 22 at pivot 27 and to frame members 54/56 at pivot 15. To adjust the rate of damping, cylinder 14 is removed from pivot 15 such that cylinder 14 can be rotated to adjust the damping rate and replaced to pivot 15. Other damping cylinder designs which have external adjustment means can also be used. Handles 44 are attached to seat support 46 by fasteners 49. Handles 18 are attached to seatback support 12 by fasteners 17. Pillow 16 is movably attached with Velcro (not shown) to seatback 20 for head support of the operator. Shelf 42 is shown retracted being supported by frame members 61/66/68 with fasteners 47. The shelf may be pulled out to position 42' with fastener moving to 47' for support of the feet during various sit-up or crunch movements by the operator. Shelf 42 is notched 39 as shown in FIG. 2 to provide area for pivot 33 to pass.

The framework comprises frame members 51 and 53 which are supported by a horizontal surface such as the floor and are connected by frame members 54 and 56. Upright frame members 62/64 are attached to frame member 53 and upright frame members 58/60 are attached to frame members 54/56. Frame members 61/66/68 are attached to upright frame members 58/60/62/64. Upright frame support 57 is attached to frame members 54/56 and connected to seat rest 55.

Figure 4:
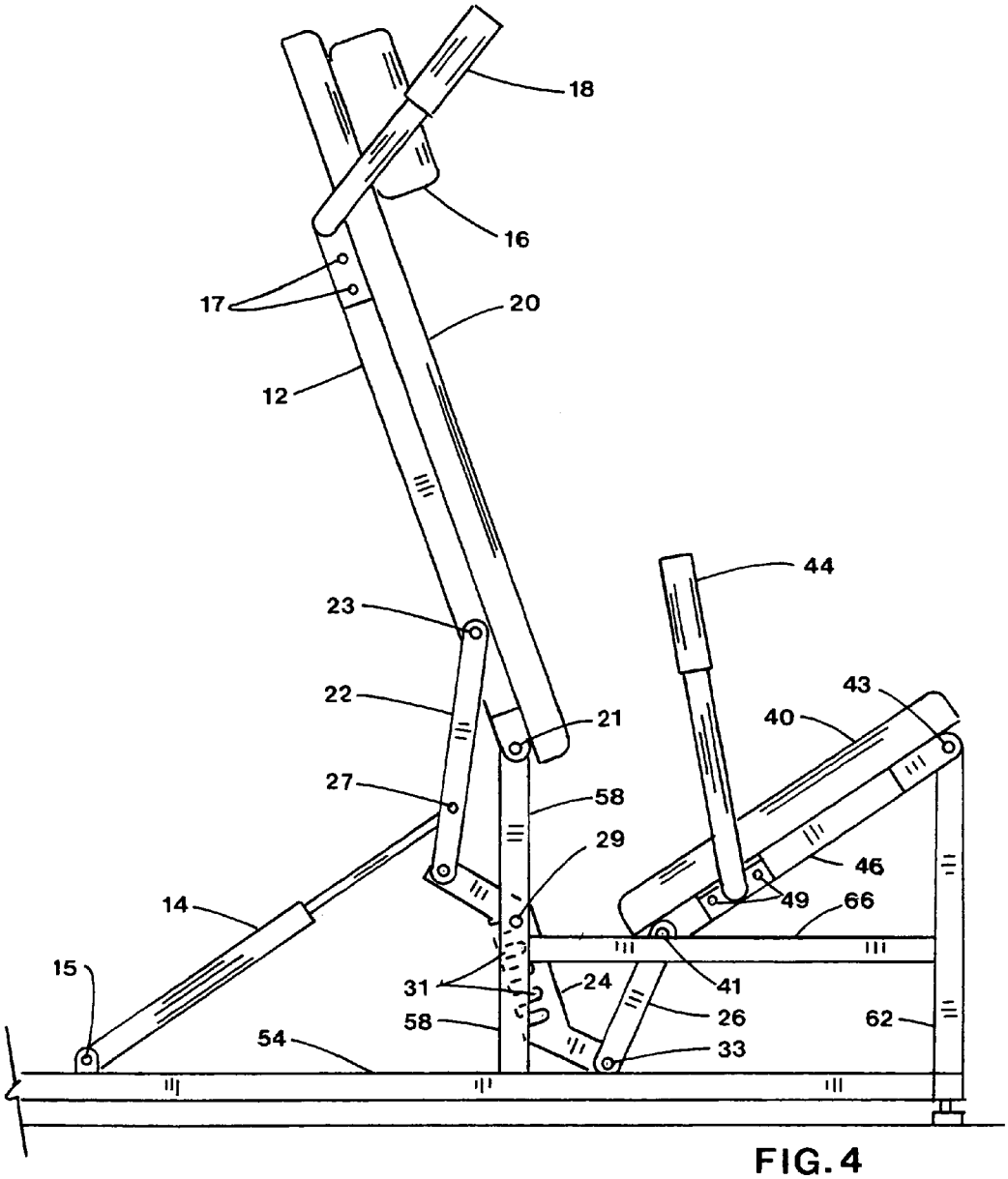
FIG. 4 is a side elevation of the preferred embodiment shown in FIG. 1 with the seat in the lowest position of adjustment.

FIG. 4 is the preferred embodiment shown with seat 40 in the lowest position with seatback 20 elevated. For the linkage proportions shown, pivot 41 is about 9 inches lower than pivot 21. This adjustment setting for rack link 24 would be used by the beginner with undeveloped abdominal muscles. Handle 44 has moved past the vertical for this adjustment setting of rack link 24.

Figure 5:
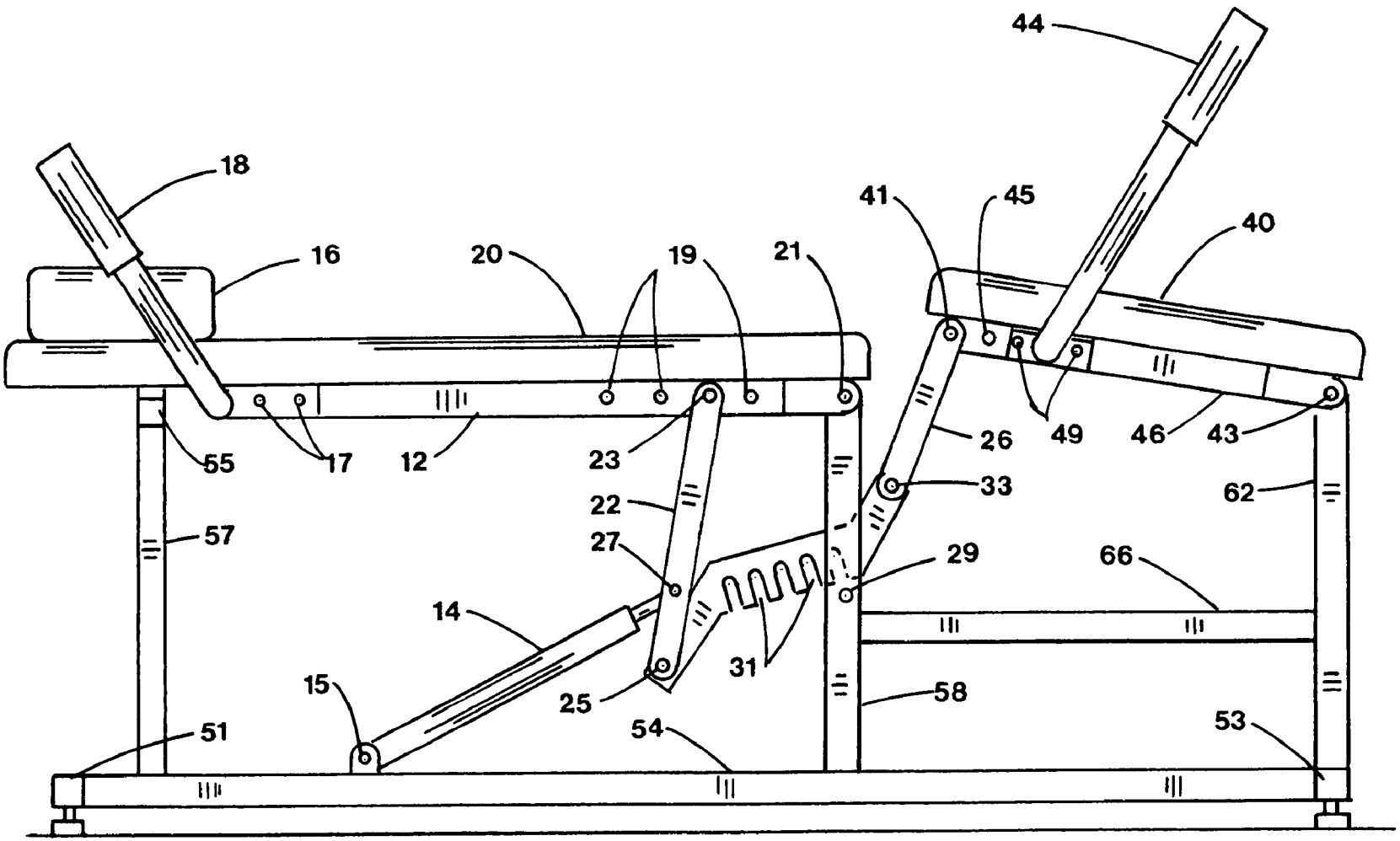
FIG. 5 is a side elevation of the preferred embodiment shown in FIG. 1 with the seat raised to allow movement of the linkage for adjustment.

FIG. 5 is the preferred embodiment shown with seat 40 raised with seatback 20 at rest. Rack link 24 raises with seat 40 to pull one of slots 31 off pivot 29. Rack link 24 is shown free of pivot 29 to move with links 22 and 26 attached to accommodate a different slot 31 and has been moved to the left of the rack link 24 position shown in FIG. 1.

Figure 6:
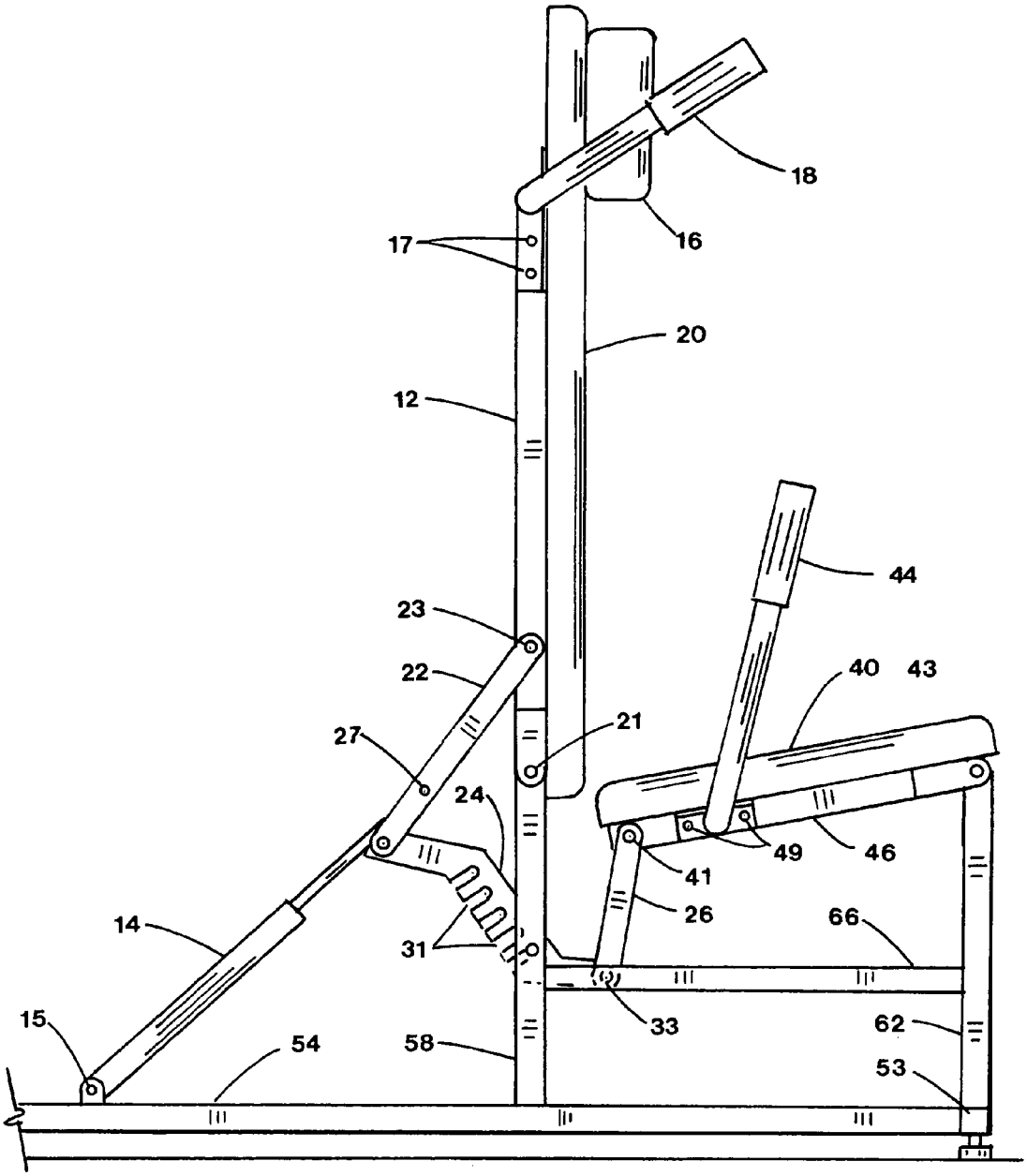
FIG. 6 is a side elevation of the preferred embodiment shown in FIG. 1 after adjustment of the linkage showing the least amount of seat movement.

FIG. 6 is the preferred embodiment shown with seat 40 lowered the minimum amount. For the proportions shown, pivot 41 is about 3 inches lower than pivot 21. Seatback 20 is shown in a vertical position. This adjustment setting for rack link 24 is suitable to tone well developed abdominal muscles. Handles 44 approach the vertical with this adjustment setting of rack link 24. It is understood that intermediate slots 31 shown on rack 24 may be used to suit the operator.

The embodiment shown herein with different adjustments of rack link 24 provides different rates of seat 40 movement relative to seatback 20 movement which exercises the abdominal and back muscles in a novel manner without back strain. It is understood that other embodiments of seat and seatback motion control can be used and remain within the scope of the present invention. The use of arms muscles during abdominal exercise is optional.

The present invention may be embodied in other specific forms without departing from its spirit or essential characteristics. The described embodiment is to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus for allowing the operator to perform sit-up movements comprising;

a framework, said framework configured to be supported by a generally horizontal surface;

a seat, said seat connected to said framework by a first frame pivot to support the lower torso of the operator;

a seatback, said seatback connected to said framework by a second frame pivot to support the upper torso of the operator;

a coupling link, said coupling link connected to said framework by a third frame pivot;

a first connecting link, said first connecting link pivotally connected to said seat and said coupling link;

a second connecting link, said second connecting link pivotally connected to said seatback and said coupling link;

said coupling link, said first connecting link and said second connecting link forming a linkage to control the movement of said seatback relative to said seat;

said seat configured to rotate relative to said framework about said first frame pivot when the lower torso of the operator applies force upon said seat whereby the movement of said seat causes a corresponding movement of said seatback to rotate about said second frame pivot as said linkage rotates about said third frame pivot.

2. The exercise apparatus according to claim 1 further comprising a pair of first handles, said first handles attached to said seat for the hands of the operator to aid the abdominal muscles during said sit-up movement.

3. The exercise apparatus according to claim 1 further comprising a pair of second handles, said second handles attached to said seatback for the hands of the operator to aid the abdominal muscles during said sit-up movement.

4. The exercise apparatus according to claim 1 further comprising a shelf, said shelf positioned between said seat and said horizontal surface to support the feet of the operator during sit-up movements.

5. The exercise apparatus according to claim 4 wherein said shelf is movable allowing said shelf to be repositioned under said seat when not in use.

6. The exercise apparatus according to claim 1 further comprising an adjustment device, said adjustment device configured to control the rate of movement of said seat relative to said seatback.

7. The exercise apparatus according to claim 6 wherein said adjustment device comprises a rack, said rack having multiple slots that can be positioned at a pivot supported by said framework when said seat is lifted.

8. The exercise apparatus according to claim 6 wherein said adjustment device comprises alternate pivot locations adjacent said seat whereby said first connecting link can be repositioned to said alternate pivot location.

9. The exercise apparatus according to claim 6 wherein said adjustment device comprises alternate pivot locations adjacent said seatback whereby said second connecting link can be repositioned to said alternate pivot location.

10. The exercise apparatus according to claim 1 further comprising a resistance device, said resistance device operably associated with said linkage and said framework to resist the movement of the operator.

11. The exercise apparatus according to claim 10 wherein said resistance device comprises adjustable damping for variable resistance.

12. The exercise apparatus according to claim 1 further comprising a pillow, said pillow movable attached to said seatback to support a portion of said upper torso.

13. An exercise apparatus for allowing the operator to perform crunch movements comprising;

a framework, said framework configured to be supported by a generally horizontal surface;

a seat, said seat connected to said framework for up and down movement about a first frame pivot;

a seatback, said seatback connected to said framework at a second frame pivot to support the back of the operator;

a linkage, said linkage comprising a plurality of interconnected links pivotally connected to said framework at a third frame pivot, and operatively associated with said seat and said seatback;

a resistance device, said resistance device operably associated with said linkage and said frame to resist the movement of the operator;

said seat configured to rotate relative to said framework about said first frame pivot when the upper torso of the operator applies a force upon said seatback whereby the downward movement of said seatback is slowed by said resistance device as said seatback rotates about said second frame pivot.

14. The exercise apparatus according to claim 13 further comprising an adjustment device, said adjustment device configured to control the rate of movement of said seat relative to said seatback.

15. The exercise apparatus according to claim 14 wherein said adjustment device comprises a rack, said rack having multiple slots that can be positioned at a pivot supported by said framework when said seat is lifted.

16. The exercise apparatus according to claim 14 wherein said adjustment device comprises alternate pivot locations adjacent said seat whereby said linkage can be repositioned to said alternate pivot location.

17. The exercise apparatus according to claim 14 wherein said adjustment device comprises alternate pivot locations adjacent said seatback whereby said linkage can be repositioned to said alternate pivot location.

18. The exercise apparatus according to claim 13 wherein said resistance device comprises adjustable means, said adjustable means allowing for variable resistance.

19. An exercise apparatus for allowing the operator to perform sit-up movements comprising;

a framework, said framework configured to be supported by a generally horizontal surface;

a seat, said seat connected to said framework for up and down rotation about a first frame pivot;

a seatback, said seatback connected to said framework at a second frame pivot to support the back of the operator;

a linkage, said linkage comprising a plurality of interconnected links connected to said framework at a third frame pivot and operatively associated with said seat and said seatback;

an adjustment device, said adjustment device operably associated with said linkage and said framework;

said seat configured to rotate relative to said framework about said first frame pivot when the lower torso of the operator applies a force upon said seat whereby said adjustment device can be changed such that the movement of said seat causes a corresponding rotation of said seatback about said second pivot that varies.

20. The exercise apparatus according to claim 19 further comprising a resistance device, said resistance device operably associated with said seatback to resist the movement of the operator.

21. The exercise apparatus according to claim 20 wherein said resistance device comprises adjustable damping for variable resistance.

22. A method for exercising the abdominal muscles comprising;

a. positioning the lower torso of the operator upon a seat that is pivotally connected to a framework at a first frame pivot, b. positioning the upper torso of the operator upon a seatback that is pivotally connected to a framework at a second frame pivot, c. providing a plurality of links pivotally connected to the seat, seatback and framework at a third frame pivot to control the movement of the seatback relative to the seat movement, and d. providing a resistance to the downward movement of the seatback, whereby a lowering of the seat with rotation about said first frame pivot due to the weight of the operator causes a corresponding upward movement of the seatback with rotation about said second frame pivot and a lowering of the seatback is slowed by the resistance.

* * * * *